US008523375B2

(12) United States Patent
Kim et al.

(10) Patent No.: US 8,523,375 B2
(45) Date of Patent: Sep. 3, 2013

(54) REFRIGERATOR

(75) Inventors: Joong Ho Kim, Kwangju (KR); Yong Man Seo, Gwang-ju (KR); Eui Young Chang, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 342 days.

(21) Appl. No.: 12/923,684

(22) Filed: Oct. 4, 2010

(65) Prior Publication Data

US 2011/0079034 A1 Apr. 7, 2011

(30) Foreign Application Priority Data

Oct. 6, 2009 (KR) ..... 10-2009-0094690

(51) Int. Cl.
*F21V 33/00* (2006.01)

(52) U.S. Cl.
USPC ..... 362/94; 62/264; 362/92; 362/554; 362/555; 362/559

(58) Field of Classification Search
USPC ..... 362/92, 94, 554, 555, 559; 62/264, 62/449
See application file for complete search history.

(56) References Cited

U.S. PATENT DOCUMENTS 6,726,341 B2 * 4/2004 Pashley et al. ..... 362/92
7,736,010 B2 * 6/2010 Lee ..... 362/92

FOREIGN PATENT DOCUMENTS

KR 10-0286035 1/2001
KR 10-0904322 6/2009

* cited by examiner

*Primary Examiner* — Stephen F Husar
(74) *Attorney, Agent, or Firm* — Staas & Halsey LLP

(57) ABSTRACT

Disclosed herein is a refrigerator which performs a light emitting operation in connection with opening and closing of doors and a home bar door. The refrigerator includes a front glass, a light guide member disposed on a rear surface of the front glass, a light emitting device disposed at the outside of the light guide member to generate light toward the light guide member, scattering members provided within the light guide member to scatter the light of the light emitting device transmitted through the light guide member, and transmitting parts provided on the front glass corresponding to the scattering members to transmit the light of the scattering members toward the front surface of each door, and the light emitting device emits light in connection with opened and closed states of the doors.

15 Claims, 7 Drawing Sheets

REFRIGERATOR

CROSS-REFERENCE TO RELATED APPLICATIONS

This application claims the benefit of Korean Patent Application No. 2009-0094690, filed on Oct. 6, 2009 in the Korean Intellectual Property Office, the disclosure of which is incorporated herein by reference.

BACKGROUND

1. Field

Embodiments relate to a refrigerator in which light is emitted through the front surface of a door.

2. Description of the Related Art

In general, refrigerators are apparatuses which store food at a low temperature in storage spaces formed therein, and cool the insides of the storage spaces using cold air generated through heat exchange with a refrigerant circulated through a refrigeration cycle, thereby keeping the stored food in an optimum state.

These refrigerators trend towards large scale and multifunctionality. At present, refrigerators having various structures and convenience devices in consideration of user convenience are on the market.

Further, since designs as well as functions of refrigerators are important factors to sell products, refrigerators having various colors, textures, and patterns have been developed.

Among these refrigerators, there is a refrigerator in which the front surface of a main body or the front surfaces of doors are made of tempered glass to bring about aesthetic appreciation as well as to express various colors and textures.

SUMMARY

Additional aspects and/or advantages will be set forth in part in the description which follows and, in part, will be apparent from the description, or may be learned by practice of the invention.

Therefore, it is an aspect of the embodiment to provide a refrigerator which emits light in connection with opening and closing of doors.

It is another aspect of the embodiment to provide a refrigerator which uses a small number of light emitting diodes as a light source.

It is a further aspect of the embodiment to provide a refrigerator which is provided with jewel members reflecting emitting light and thus being brilliant.

Additional aspects of the embodiment will be set forth in part in the description which follows and, in part, will be obvious from the description, or may be learned by practice of the invention.

In accordance with one aspect of the embodiment, a refrigerator includes a main body, storage chambers provided within the main body, and doors to open and close the storage chambers, each door including a front glass forming an external appearance of a front surface of each door, a light guide member disposed on a rear surface of the front glass, a light emitting device disposed at the outside of the light guide member to generate light toward the light guide member, scattering members provided within the light guide member to scatter the light of the light emitting device transmitted through the light guide member, and transmitting parts provided on the front glass corresponding to the scattering members to transmit the light of the scattering members toward the front surface of each door, wherein the light emitting device emits light in connection with opened and closed states of the doors.

The light emitting device may emit light under the condition that at least one of the doors is opened.

The light emitting device may emit light to inform a user that at least one of the doors is opened, if a predetermined time from the opening of the at least one of the doors elapses.

The light emitting device may emit red light.

The light emitting device may emit green light, if all of the doors are closed, and emit red light, if at least one of the doors is opened.

The light emitting device may emit green light, if all of the doors are closed, emit yellow light, if at least one of the doors is opened, and emit red light, if a designated time from the opening of the at least one of the doors elapses.

The refrigerator may further include a home bar door allowing stored articles to be taken out of or put into the refrigerator without opening of the doors, and the light emitting device may emit light in connection with opened and closed states of the doors and the home bar door.

The light emitting device may emit light under the condition that at least one of the doors and the home bar door is opened.

The light emitting device may emit light to inform a user that at least one of the doors and the home bar door is opened, if a designated time from the opening of the at least one of the doors and the home bar door elapses.

The light emitting device may emit red light.

The light emitting device may emit green light, if all of the doors and the home bar door are closed, and emit red light, if at least one of the doors and the home bar door is opened.

The light emitting device may emit green light, if all of the doors and the home bar door are closed, emit yellow light, if at least one of the doors and the home bar door is opened, and emit red light, if a designated time from the opening of the at least one of the doors and the home bar door elapses.

In accordance with another aspect of the embodiment, a refrigerator includes a main body, storage chambers provided within the main body, and doors to open and close the storage chambers, each door including a front glass forming an external appearance of a front surface of each door, a light guide member disposed on a rear surface of the front glass, a light emitting device disposed at the outside of the light guide member to generate light toward the light guide member, scattering members provided within the light guide member to scatter the light of the light emitting device transmitted through the light guide member, and transmitting parts provided on the front glass corresponding to the scattering members to transmit the light of the scattering members toward the front surface of the door, wherein the light emitting device changes a light emitting state thereof according to opened and closed states of the doors.

The light emitting device may include a plurality of light emitting diodes (LEDs), and the plurality of light emitting diodes may be arranged in a line along the edge of the light guide member.

The scattering members may include jewel members which are colored and brilliant.

The jewel members may be made of cubic zirconia.

The light guide member may be made of acrylic resin.

Each door may further include an upper cap covering an upper end thereof, and the light emitting device may be disposed in the upper cap.

Each door may further include a cover to fix the light emitting device to the upper cap.

The light emitting device may further include a circuit board to control the plurality of light emitting diodes.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
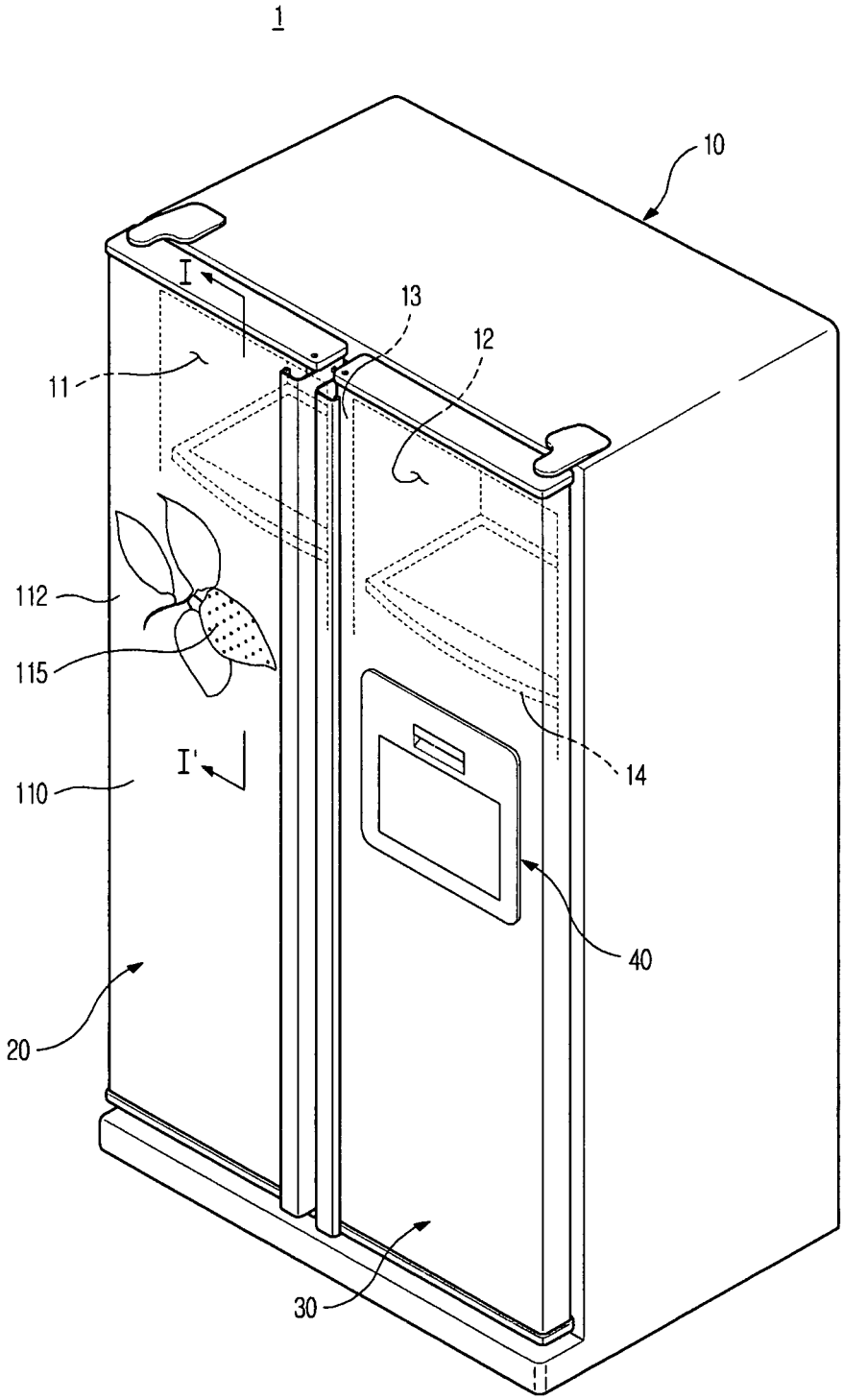
FIG. 1 is a perspective view illustrating an external appearance of a refrigerator in accordance with one embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a perspective view illustrating an external appearance of a refrigerator in accordance with one embodiment.

As shown in FIG. 1, the refrigerator 1 in accordance with this embodiment includes a main body 10 provided with a plurality of storage chambers 11 and 12 formed therein, doors 20 and 30 respectively provided on the front surfaces of the storage chambers 11 and 12 to open and close the storage chambers 11 and 12, cool air supply devices (not shown) respectively provided in the storage chambers 11 and 12 to supply cool air to the insides of the storage chambers 11 and 12, and a machinery chamber (not shown), in which electric components are installed, provided at a rear region of a lower portion of the main body 10. A compressor (not shown) forms a refrigeration cycle together with a condenser (not shown), an expansion device (not shown), and an evaporator (not shown), and the refrigeration cycle generates cool air to be discharged to the cool air supply devices.

The main body 10 may include an inner case and an outer case, and a gap between the inner case and the outer case is filled with a foaming agent so as to keep the insulation state of the inside of the main body 10.

The storage chambers 11 and 12 may include a first storage chamber 11 provided at the left portion of the main body 10 and a second storage chamber 12 provided at the right portion of the main body 10. The first storage chamber 11 and the second storage chamber 12 are divided form each other by an intermediate diaphragm 13. Racks 14 to collect food to be stored are provided in the respective storage chambers 11 and 12.

A first door 20 and a second door 30 are respectively hinged to the front surfaces of the first storage chamber 11 and the second storage chamber 12, thereby respectively opening and closing the first storage chamber 11 and the second storage chamber 12.

A home bar door 40 may be provided at the front surface of the second door 30 so as to allow a user to take stored food out of the storage chamber 12 without opening the second door 30. The home bar door 40 is used to store food, which is relatively frequently placed in and taken out of the storage chamber 12.

Hereinafter, the doors 20 and 30 and internal structures thereof will be described in detail.

Figure 2:
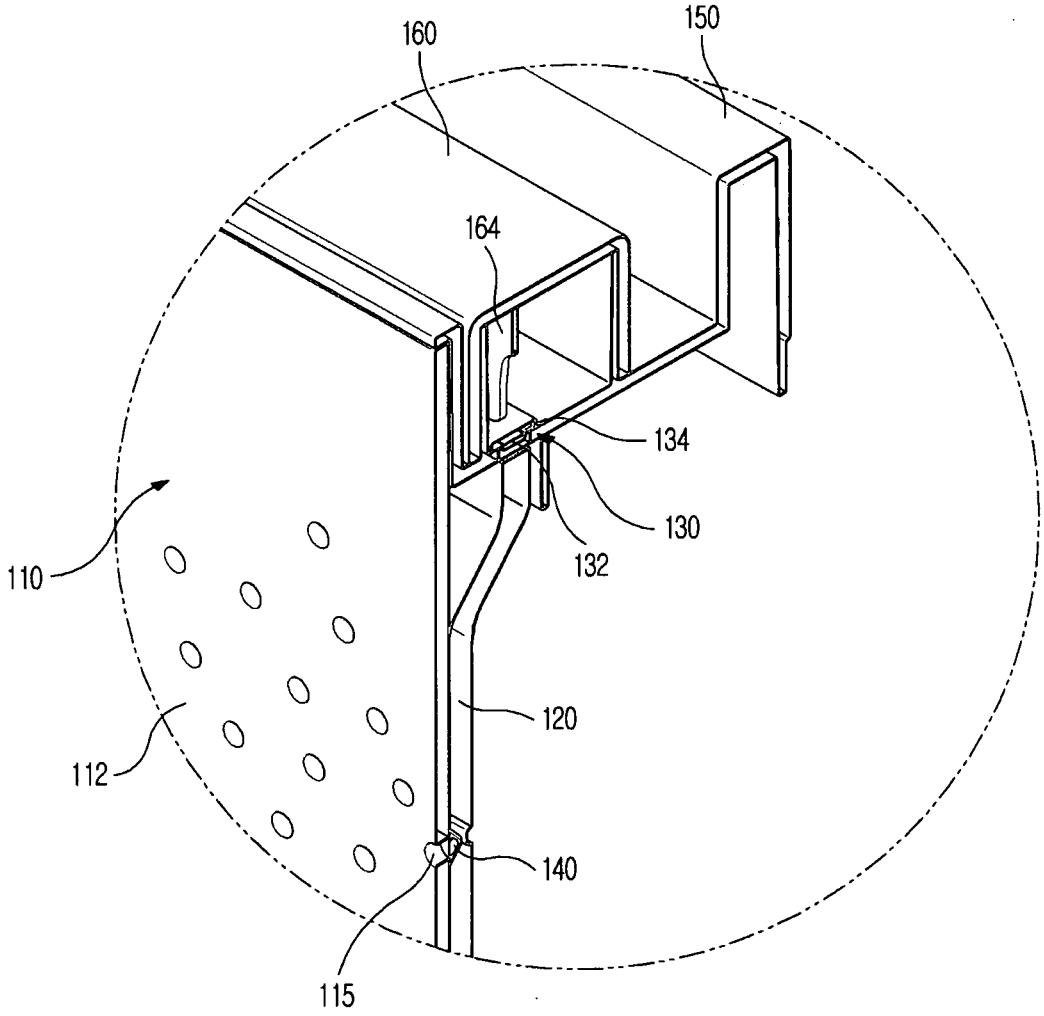
FIG. 2 is a perspective view taken along the line I-I' of FIG. 1.
Figure 3:
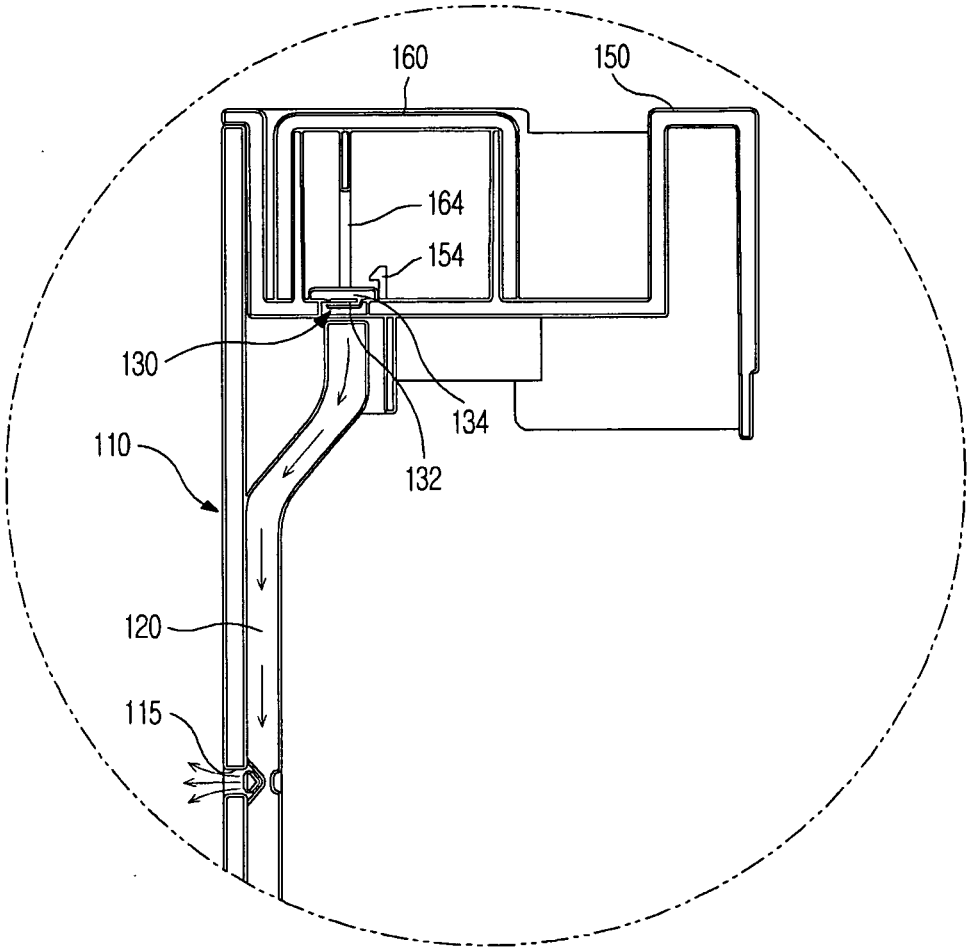
FIG. 3 is a longitudinal-sectional view of FIG. 2.

FIG. 2 is a perspective view taken along the line I-I' of FIG. 1, and FIG. 3 is a longitudinal-sectional view of FIG. 2.

As shown in FIGS. 2 and 3, the first door 20 includes a front glass 110 forming the external appearance of the front surface of the first door 20, a light guide member 120 disposed on the rear surface of the front glass 110, a light emitting device 130 disposed at the outside of the light guide member 120 to generate light toward the light guide member 120, a plurality of scattering members 140 provided within the light guide member 120 to scatter the light of the light emitting device 130 transmitted through the light guide member 120, and a plurality of transmitting parts 115 provided on the front glass 110 corresponding to the plurality of scattering members 140 to transmit the light of the scattering members 140 toward the front surface of the front glass 110.

The front glass 110 forms the external appearance of the front surface of the refrigerator 1, and is made of tempered glass which is capable of transmitting light. A printing part 112 and the transmitting parts 115 are formed on the surface of the front glass 110.

The printing part 112 prevents light generated from the light emitting device 130, which will be described later, from being irradiated to the outside, and is formed by attaching a light blocking sheet to the front glass 110 or painting the front glass 110.

The plural transmitting parts 115 are provided at parts of the front glass 110 where the printing part 112 is not formed, and are formed by not painting the front glass 110 so as to transmit light. The plural transmitting parts 115 form a designated shape, seen from the front surface of the first door 20. In this embodiment, the plural transmitting parts 15 are formed in a flower petal shape. Further, the shape formed by the plural transmitting parts 15 may be varied, such as a letter or a logo. However, it is not limited thereto.

The light guide member 120 is disposed on the rear surface of the front glass 110. The light guide member 120 serves to transmit light generated from the light emitting device 130, and may be made of acrylic resin.

The light emitting device 130 serving to generate light is disposed above the light guide member 120. The light emitting device 130 is located within an upper cap 150 covering the upper end of the first door 20, and is disposed adjacent to the upper portion of the light guide member 120. Further, a light guide device cover 160 covers the upper portion of the light emitting device 130. The light emitting device 130 keeps a fixed state thereof using an upper fixing part 164 formed on the light emitting device cover 160 and a hook fixing part 154 formed on the upper cap 150.

The light emitting device 130 includes a plurality of light emitting diodes (LEDs) 132, and a circuit board 134 to control emission of light from the plural light emitting diodes 132.

The plural light emitting diodes 132 are arranged in a line along the upper portion of the light guide member 120, and irradiate light toward the light guide member 120. The plural light emitting diodes 132 may emit red, green, and yellow light, respectively. Since the light emitting diodes 132 have a long life span, high intensity of illumination, and low heat dissipation amount and power consumption rate, the light emitting diodes 132 are used as the light source. Of course, the plural light emitting diodes 132 may emit light of various colors, in addition to red, green, and yellow light.

The circuit board 134 which is electrically connected to the plural light emitting diodes 132 supplies power to the plural light emitting diodes 132 and transmits a signal to control emission of light from the light emitting diodes 132.

The light emitting device 130 changes a light emission state thereof according to opening and closing of the doors 20 and 30, and a detailed description thereof will be described later.

The plural scattering members 140 are mounted on the light guide member 120 at positions corresponding to the transmitting parts 115 of the front glass 110. The scattering members 140 scatter light transmitted through the light guide member 120 toward the transmitting parts 115.

As the scattering members 140, jewel members 140 which are colored and brilliant are used. In this embodiment, the jewel members 140 are made of cubic zirconia. Cubic zirconia, which is a kind of artificial diamond, is used due to its characteristics, such as low cost, long life span, and similarity to diamond. It is understood that the jewel member can be made of different kinds of material.

Hereinafter, a principle of emitting light generated from the light emitting device 130 toward the front surface of the first door 20 will be described.

When power is supplied to the light emitting device 130, the circuit board 134 of the light emitting device 130 drives the plural light emitting diodes 132 to emit light, and the emitted light is transmitted to the light guide member 120. The light transmitted to the light guide member 120 contacts the scattering members 140, and the scattering members 140 scatter the light. The scattered light is transmitted by the transmitting parts 115 of the front glass 110, and a user may see the light transmitted by the front surface of the first door 20. Here, the printing part 112 of the front glass 110 blocks light, and thus does not transmit light to the outside.

A conventional refrigerator includes separate light emitting diodes installed at desired positions of the front surface of the refrigerator to emit light, thereby requiring a large number of parts and causing high power consumption. However, in accordance with this embodiment, a small number of the light emitting diodes 132 is installed at the outside of the light guide member 120, and light transmitted to the light guide member 120 is emitted to the front surface of the refrigerator 1 through the plural scattering members 140 and the plural transmitting parts 115, thereby reducing the number of parts required and reducing power consumption. Further, the scattering members 140 made of cubic zirconia are brilliant.

The above-described internal structure of the first door 20 may be applied to the second door 30.

Hereinafter, a light emitting operation of a refrigerator 1 in connection with opening and closing of doors 20 and 30 and a home bar door 40 in accordance with one embodiment of the present invention will be described.

Figure 4:
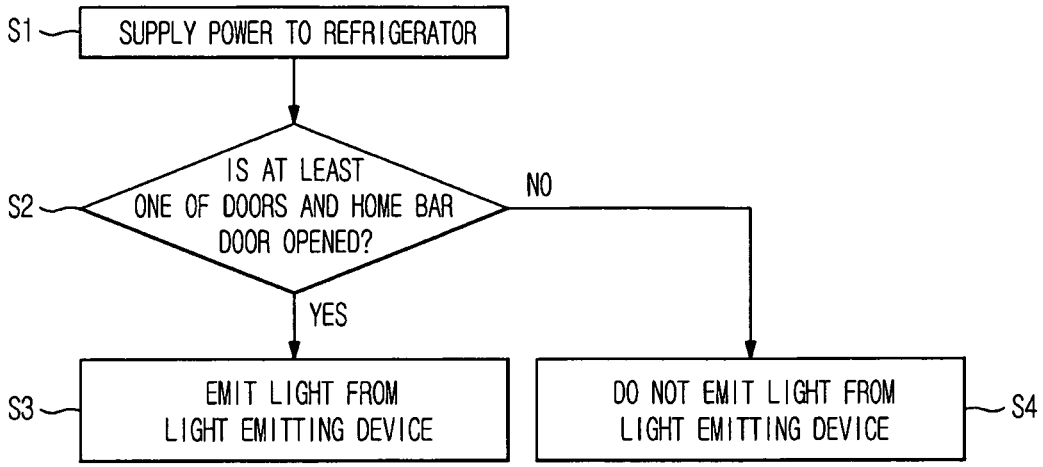
FIG. 4 is a block diagram illustrating a light emitting operation of a refrigerator in connection with opening and closing of doors and a home bar door in accordance with one embodiment.

FIG. 4 is a block diagram illustrating the light emitting operation of the refrigerator 1 in connection with opening and closing of the doors 20 and 30 and the home bar door 40 in accordance with this embodiment.

As shown in FIG. 4, power is first supplied to the refrigerator 1 (operation S1), and then a sensor (not shown) provided in the refrigerator 1 judges whether or not at least one of the doors 20 and 30 and the home bar door 40 is opened (operation S2). If it is judged that at least one of the doors 20 and 30 and the home bar door 40 is opened, the light emitting device 130 is operated and thus emits light to the front surfaces of the doors 20 and 30 (operation S3). On the other hand, if it is judged that all of the doors 20 and 30 and the home bar door 40 are closed, the light emitting device 130 does not emit light (operation S4).

When the refrigerator 1 is operated in this way, a user senses light emitted through the front surface of the refrigerator 1, and recognizes that at least one of the doors 20 and 30 and the home bar door 40 is opened. That is, the refrigerator 1 performs a function of warning the user that the at least one of the doors 20 and 30 and the home bar door 40 is opened and cool air is leaked. Here, the light emitting device 130 emits red light as a warning. Of course, the light emitting device 130 may emit light of other colors.

Hereinafter, a light emitting operation of a refrigerator 1 in connection with opening and closing of doors 20 and 30 and a home bar door 40 in accordance with a further embodiment of the present invention will be described. A part of the construction and operation of this embodiment are substantially the same as those of the earlier embodiment, as shown in FIG. 4, and a detailed description thereof will thus be omitted because it is considered to be unnecessary.

Figure 5:
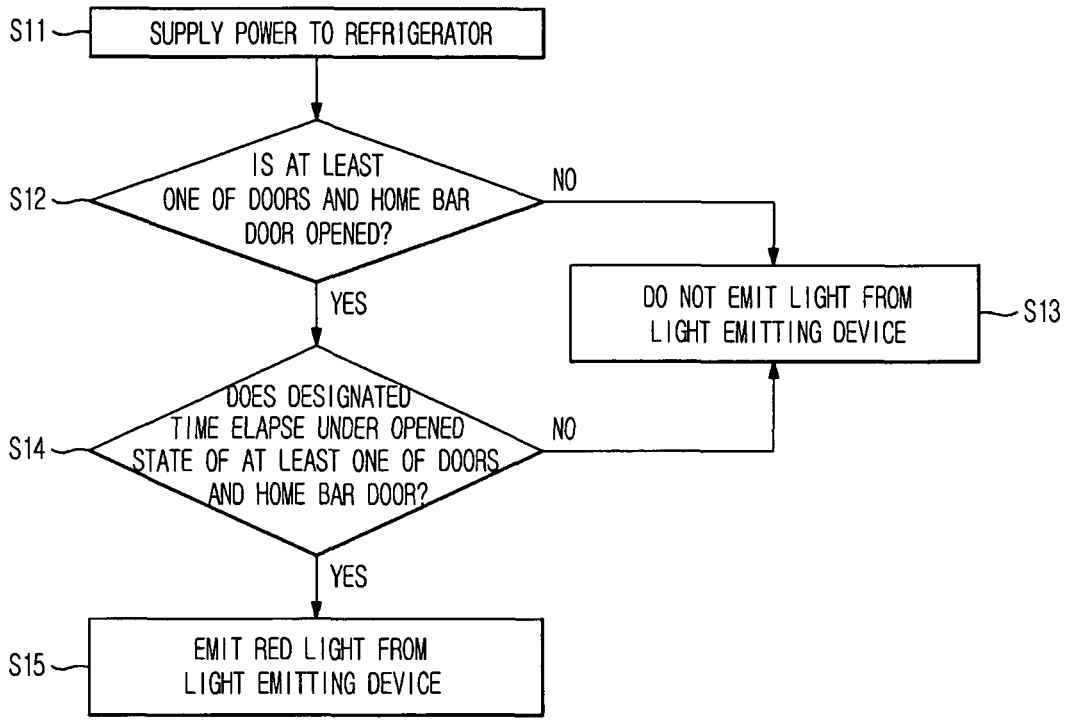
FIG. 5 is a block diagram illustrating a light emitting operation of a refrigerator in connection with opening and closing of doors and a home bar door in accordance with a further embodiment.

FIG. 5 is a block diagram illustrating the light emitting operation of the refrigerator 1 in connection with opening and closing of the doors 20 and 30 and the home bar door 40 in accordance with an embodiment.

As shown in FIG. 5, power is first supplied to the refrigerator 1 (operation S11), and then a sensor (not shown) of the refrigerator 1 determines whether at least one of the doors 20 and 30 and the home bar door 40 is opened (operation S12). If it is judged that at least one of the doors 20 and 30 and the home bar door 40 is not opened, the light emitting device 130 does not emit light (operation S13). On the other hand, if it is judged that at least one of the doors 20 and 30 and the home bar door 40 is opened, it is determined whether the opened state of at least one of the doors 20 and 30 and the home bar door 40 is continued for a designated time (operation S14). If the opened state of at least one of the doors 20 and 30 and the home bar door 40 is continued even after the designated time elapses, the light emitting device 130 emits red light to the front surfaces of the doors 20 and 30 (operation S15), and if the opened state of at least one of the doors 20 and 30 and the home bar door 40 is not continued even after the designated time elapses, the light emitting device 130 does not emit light (operation S13).

Such an operation of the refrigerator 1 provides a warning the user to close the door 20 or 30 or the home bar door 40 in that cool air loss is considerably high due to elapse of the designated time under the opened state of at least one of the doors 20 and 30 and the home bar door 40. Here, it is proper to set the designated time to 20 seconds to 1 minute. Further, the light emitting device 130 emits red light as a warning. Of course, the light emitting device 130 may emit light of other colors.

Hereinafter, a light emitting operation of a refrigerator 1 in connection with opening and closing of doors 20 and 30 and a home bar door 40 in accordance with another embodiment will be described. A part of the construction and operation of this embodiment are substantially the same as those of the earlier embodiment, as shown in FIG. 4, and a detailed description thereof will thus be omitted because it is considered to be unnecessary.

Figure 6:
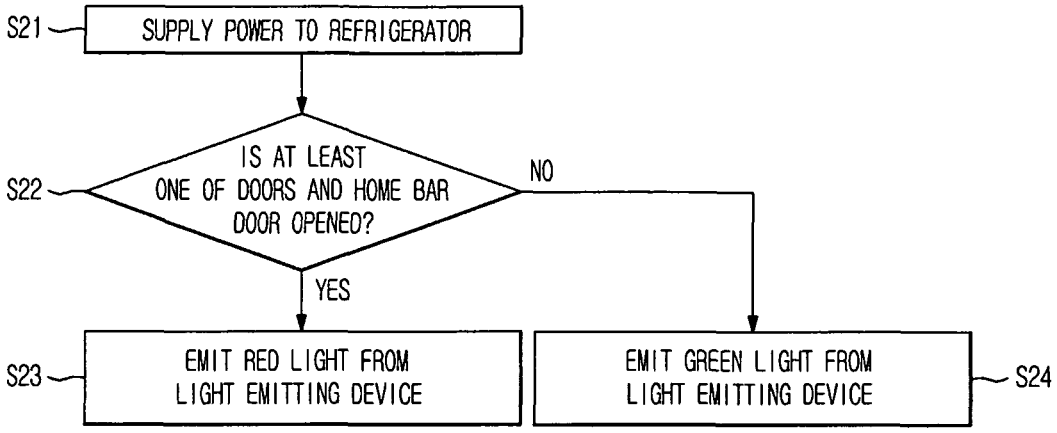
FIG. 6 is a block diagram illustrating a light emitting operation of a refrigerator in connection with opening and closing of doors and a home bar door in accordance with another embodiment.

FIG. 6 is a block diagram illustrating the light emitting operation of the refrigerator 1 in connection with opening and closing of the doors 20 and 30 and the home bar door 40 in accordance with this embodiment.

As shown in FIG. 6, power is first supplied to the refrigerator 1 (operation S21), and then a sensor (not shown) of the refrigerator 1 determines whether at least one of the doors 20 and 30 and the home bar door 40 is opened (operation S22). If it is determined that at least one of the doors 20 and 30 and the home bar door 40 is opened, the light emitting device 130 emits red light to the front surfaces of the doors 20 and 30 (operation S23). On the other hand, if it is judged that all of the doors 20 and 30 and the home bar door 40 are closed, the light emitting device 130 emits green light to the front surfaces of the doors 20 and 30 (operation S24).

If at least one of the doors 20 and 30 and the home bar door 40 is opened and cool air leaks, the light emitting device 130 emits red light giving the user a warning to close the door 20 or 30 or the home bar door 40. On the other hand, if all of the doors 20 and 30 and the home bar door 40 are closed, the light emitting device 130 emits green light meaning that the refrigerator 1 is normally operated.

Hereinafter, a light emitting operation of a refrigerator 1 in connection with opening and closing of doors 20 and 30 and a home bar door 40 in accordance with another embodiment of the present invention. A part of the construction and operation of this embodiment are substantially the same as those of the earlier embodiment, as shown in FIG. 4, and a detailed description thereof will thus be omitted because it is considered to be unnecessary.

Figure 7:
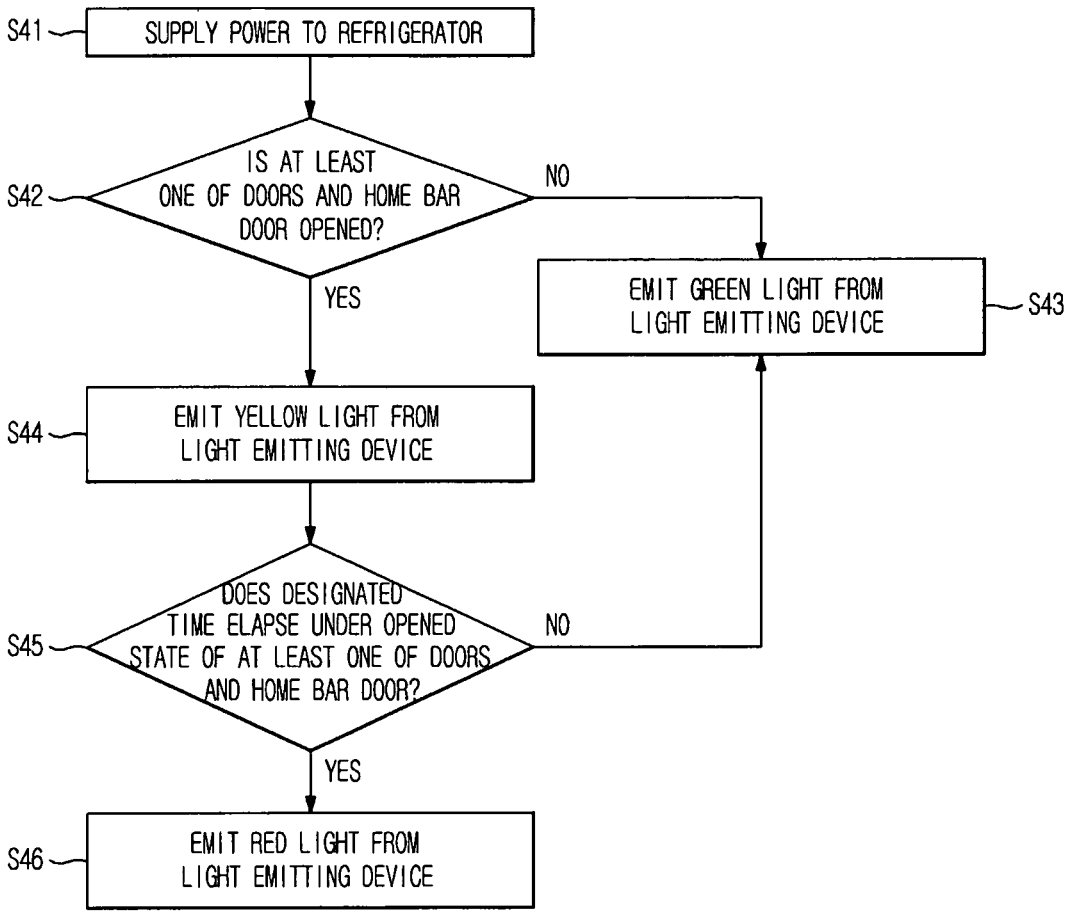
FIG. 7 is a block diagram illustrating a light emitting operation of a refrigerator in connection with opening and closing of doors and a home bar door in accordance with another embodiment.

FIG. 7 is a block diagram illustrating the light emitting operation of the refrigerator 1 in connection with opening and closing of the doors 20 and 30 and the home bar door 40 in accordance with this embodiment.

As shown in FIG. 7, power is first supplied to the refrigerator 1 (operation S41), and then a sensor (not shown) of the refrigerator 1 determines whether or not at least one of the doors 20 and 30 and the home bar door 40 is opened (operation S42). If it is determined that all of the doors 20 and 30 and the home bar door 40 are closed, the light emitting device 130 emits green light to the front surfaces of the doors 20 and 30 (operation S43). On the other hand, if it is determined that at least one of the doors 20 and 30 and the home bar door 40 is opened, the light emitting device 130 emits yellow light (operation S44). If it is determined that at least one of the doors 20 and 30 and the home bar door 40 is opened, it is determined whether the opened state of at least one of the doors 20 and 30 and the home bar door 40 is continued for a designated time (operation S45). If the designated time elapses under the opened state of at least one of the doors 20 and 30 and the home bar door 40, the light emitting device 130 emits red light (operation S46), and if all of the doors 20 and 30 and the home bar door 40 are closed before the designated time elapses, the light emitting device 130 again emits green light (operation S43).

Such a light emitting operation of the refrigerator 1 informs the user of the opening or closing state of the door 20 or 30 or the home bar door 40 according to colors of light emitted from the light emitting device 130. That is, if all of the doors 20 and 30 and the home bar door 40 are closed, the light emitting device 130 emits green light meaning that the refrigerator 1 is normally operated without a high energy loss, if at least one of the doors 20 and 30 and the home bar door 40 is opened, the light emitting device 130 emits yellow light to simply inform the user of the opened state of at least one of the doors 20 and 30 and the home bar door 40, and if the opened state of the doors 20 and 30 and the home bar door 40 is continued for the designated time, the light emitting device 130 emits red light to give the user a warning to close the door 20 or 30 or the home bar door 40 in that cool air loss is high.

As described above, the light emitting device 130 of the refrigerator 1 informs a user of the opened or closed state of the door 20 or 30 or the home bar door 40 through various methods, thereby allowing the user to easily recognize the opened or closed state of the door 20 or 30 or the home bar door 40.

Further, the refrigerator 1 has a fine external appearance, and an excellent emotional quality.

As is apparent from the above description, a refrigerator in accordance with one embodiment emits light through the front surface of a door in connection with opening and closing of doors, thereby providing an aesthetic sense to a user.

Further, when at least one of the doors or a home bar door is opened, a light emitting device emits light, thereby informing the user that at least one of the doors or the home bar door is opened. It is understood that a warning sound signal is simultaneously output with emitting light to inform the user that at least one of the doors or the home bar door is opened.

Further, a small number of light emitting diodes is used to perform such a light emitting operation of the refrigerator, thereby reducing power consumption and decreasing the number of parts required.

Moreover, jewel members reflect the emitted light, thus being brilliant.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising a main body, storage chambers provided within the main body, and doors to open and close the storage chambers, at least one of the doors including:

a front glass forming an external appearance of a front surface of each door;

a light guide member disposed on a rear surface of the front glass;

a light emitting device disposed at the outside of the light guide member to generate light toward the light guide member;

scattering members provided within the light guide member to scatter the light of the light emitting device transmitted through the light guide member; and transmitting parts provided on the front glass corresponding to the scattering members to transmit the light of the scattering members toward the front surface of each door, wherein the light emitting device emits light in connection with opened and closed states of the doors.

2. The refrigerator according to claim 1, wherein the light emitting device emits light under the condition that at least one of the doors is opened.

3. The refrigerator according to claim 1, wherein the light emitting device emits light to inform a user that at least one of the doors is opened, if a predetermined time from the opening of the at least one of the doors elapses.

4. The refrigerator according to claim 1, further comprising a home bar door allowing stored articles to be taken out of or put into the refrigerator without opening of the doors, wherein the light emitting device emits light in connection with opened and closed states of the doors and the home bar door.

5. The refrigerator according to claim 4, wherein the light emitting device emits light under the condition that at least one of the doors and the home bar door is opened.

6. The refrigerator according to claim 5, wherein the light emitting device emits light to inform a user that at least one of the doors and the home bar door is opened, if a pretermined time from the opening of the at least one of the doors and the home bar door elapses.

7. The refrigerator according to claim 1, wherein a number of the light emitting devices is smaller than a number of the scattering members.

8. A refrigerator comprising a main body, storage chambers provided within the main body, and doors to open and close the storage chambers, at least one of the doors including:

a front glass forming an external appearance of a front surface of each door;

a light guide member disposed on a rear surface of the front glass;

a light emitting device disposed at the outside of the light guide member to generate light toward the light guide member;

scattering members provided within the light guide member to scatter the light of the light emitting device transmitted through the light guide member; and transmitting parts provided on the front glass corresponding to the scattering members to transmit the light of the scattering members toward the front surface of the door, wherein the light emitting device changes a light emitting state thereof according to opened and closed states of the doors.

9. The refrigerator according to claim 8, wherein:

the light emitting device includes a plurality of light emitting diodes (LEDs); and the plurality of light emitting diodes is arranged in a line along the edge of the light guide member.

10. The refrigerator according to claim 8, wherein the scattering members include jewel members which are colored and brilliant.

11. The refrigerator according to claim 10, wherein the jewel members are made of cubic zirconia.

12. The refrigerator according to claim 8, wherein the light guide member is made of acrylic resin.

13. The refrigerator according to claim 9, wherein:

each door further includes an upper cap covering an upper end thereof; and the light emitting device is disposed in the upper cap.

14. The refrigerator according to claim 13, wherein each door further includes a cover to fix the light emitting device to the upper cap.

15. The refrigerator according to claim 9, wherein the light emitting device further includes a circuit board to control the plurality of light emitting diodes.

* * * * *

UNITED STATES PATENT AND TRADEMARK OFFICE

CERTIFICATE OF CORRECTION

PATENT NO. : 8,523,375 B2
APPLICATION NO. : 12/923684
DATED : September 3, 2013
INVENTOR(S) : Joong Ho Kim et al.

It is certified that error appears in the above-identified patent and that said Letters Patent is hereby corrected as shown below:

In the Claims

In Column 9, Line 12, In Claim 6, delete "pretermined" and insert -- predetermined --, therefor.

Signed and Sealed this
Fourth Day of February, 2014

Michelle K. Lee

Michelle K. Lee
*Deputy Director of the United States Patent and Trademark Office*